US006089547A

United States Patent [19]

Juelich et al.

[11] Patent Number: 6,089,547

[45] Date of Patent: Jul. 18, 2000

[54] METHOD AND APPARATUS FOR WINCH UPGRADING

[75] Inventors: Richard A. Juelich, Stillwater; Pierre C. Delago, Afton; John C. Lundell, Brooklyn Park, all of Minn.

[73] Assignee: AmClyde Engineered Products, Inc., St. Paul, Minn.

[21] Appl. No.: 08/938,272

[22] Filed: Sep. 26, 1997

Related U.S. Application Data

[60] Provisional application No. 60/033,413, Dec. 18, 1996.

[51] Int. Cl.[7] ..... B66D 1/00

[52] U.S. Cl. ..... 254/329; 254/278; 254/280; 254/316; 254/322; 114/230.23

[58] Field of Search ..... 254/278, 279, 254/280, 283, 289, 295, 316, 322, 329, 382; 114/230.1, 230.11, 230.2, 230.21, 230.23

[56] References Cited

U.S. PATENT DOCUMENTS

| | | | |
|---|---|---|---|
| 1,265,612 | 5/1918 | Cocke | 254/289 |
| 1,610,462 | 12/1926 | Matthewson et al. | 254/322 |
| 2,221,359 | 11/1940 | Nesbitt | 254/289 |
| 2,370,834 | 3/1945 | Ball | 254/322 |
| 3,223,386 | 12/1965 | Frisbie et al. | 254/316 |
| 3,300,187 | 1/1967 | Saxe et al. | 114/230.23 X |
| 3,927,867 | 12/1975 | Herchenroder | 254/382 |
| 3,966,170 | 6/1976 | McKenna | 254/280 |
| 4,634,102 | 1/1987 | Appling et al. | 254/278 X |

OTHER PUBLICATIONS

A Skagit TMW/350 product information brochure from Continental Emsco.

An article entitled "Ready For The Deep" from a Continental Emsco publication titled *50 Years of Offshore Oil & Gas Development 1947–1977,* pp. 146–147.

*Primary Examiner*—Donald P. Walsh
*Assistant Examiner*—Emmanuel M. Marcelo
*Attorney, Agent, or Firm*—Dorsey & Whitney LLP

[57] ABSTRACT

A drum winch is replaced with a traction winch module. The traction winch module is mounted on and supported by the existing mooring winch frame of the drum winch. The traction winch module includes a traction frame, a front traction drum, and a rear traction drum. A portion of the drive system from the drum winch may be retained and used to drive the traction winch module. In one embodiment, the traction winch module is designed to mount between pillow blocks from the existing mooring winch frame. In addition, the power train and load-sensing systems from the existing drum winch may be used with the converted traction winch to drive the drive shaft and to provide the converted traction winch with tension information, respectively.

41 Claims, 3 Drawing Sheets

METHOD AND APPARATUS FOR WINCH UPGRADING

This application claims the benefit of and hereby incorporates by reference earlier filed provisional application App. Ser. No. 60/033,413, filed on Dec. 18, 1996.

TECHNICAL FIELD

The present invention relates to winches and other apparatus for handling mooring lines for offshore loading vessels. More specifically, the present invention relates to a method for and apparatus upgrading a conventional drum winch by conversion into a traction winch, as well as a kit for such conversion.

BACKGROUND

Offshore loading vessels have for many years employed drum winches to draw in and hold lines, particularly the long mooring lines used to anchor an offshore loading vessel to the sea bottom. As the depths where offshore loading vessels are used have increased, the drum winches used to draw in and store the mooring lines have been pushed toward their limits. This has occurred in two ways. First, the size of the winch permits it to hold between its end flanges only a certain number of wraps of a line having a given line diameter. This means that only a limited length of line can be accommodated before the winch simply becomes incapable of holding any further line that it may draw in. Second, as greater lengths of line are used and stored on the drum, the winch loses mechanical advantage and requires greater driving force in order to be turned. This need for greater driving force means greater wear and tear on motors, power trains, driving pinions and other components involved in turning the drum. It may also lead to breakdown.

Motors and other components can be upgraded. In certain situations, additional drive mechanisms can be added to upgrade existing drive mechanisms. All these solutions can involve one or more disadvantages. First, any changes in an existing drum mooring winch may result in throwing the original design out of balance and causing new problems. Also, it is normally quite expensive to move the entire offshore loading vessel to a shipyard or other such location for such work. Further, if the drum winch alone is to be brought to the shipyard, it must be taken out of service, removed from its mounting, transported, upgraded, transported back, remounted and restored to service. Finally, if the upgrading work is done out on the offshore loading vessel, this must often be done under harsh conditions and with the limited resources available on the offshore loading vessel for moving heavy equipment. Thus, complex and elaborate winch upgrading work poses difficulties. Moreover, the design of drum winches, even if upgraded with adequate power, is such that they will always have a capacity limit based on their size and the amount of line they can hold.

Traction winches are a known solution to the problem of line capacity, because they need only hold a few wraps of line, feeding the line drawn in to a take-up reel. However, traction winches have two drums and a take-up reel, a fundamentally different design. They cannot be directly substituted for a drum winch in most situations. Installing the two drums for a traction winch can lead to significant reworking of the mounting and driving structures, with all the disadvantages mentioned above encountered in replacement or upgrading of a drum winch. It may also require accommodations for the way line loads and various other forces present at the traction winch differ from the forces applied by the replaced winch drum.

It would be desirable to find an effective and less complicated way to upgrade a drum winch to provide increased mooring capability.

SUMMARY

Accordingly, the present invention provides a method for upgrading a drum winch by conversion into a traction winch while avoiding the disadvantages associated with the prior solutions.

The winch drum from a drum winch is replaced with a traction winch module. The traction winch module is positioned on and supported by the existing mooring winch frame of the drum winch. The traction winch module includes a traction winch frame, a front traction drum and a rear traction drum. The traction winch frame is affixed to the mooring winch frame. The drive shaft from the drum winch may be retained and linked to drive the traction winch module in order to haul-in and pay-out the mooring line.

In one embodiment, the traction winch module is designed to mount between pillow blocks from the existing mooring winch frame. In addition, the power train and load-sensing systems from the existing drum winch may be used with the replacement traction winch to drive it and provide it with tension information, respectively.

DETAILED DESCRIPTION

Description of a First Embodiment

In one embodiment of the present invention a unitary traction winch module is utilized to convert an existing drum winch into a traction winch for hauling-in and paying-out a mooring line. The winch drum from the drum winch is replaced by a traction winch module, and a take-up reel is provided to store the mooring line, as well as to generate the necessary back tension when the line is being hauled-in by the traction winch module.

Existing Drum Winch

Figure 1:
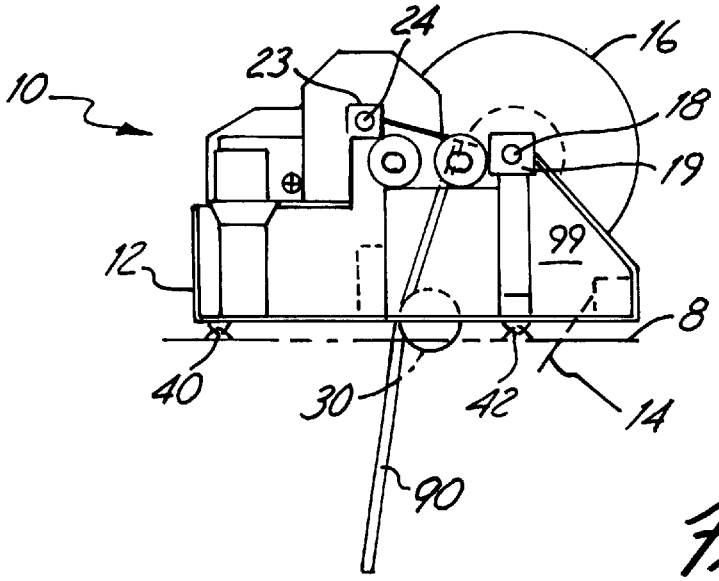
Fig. 1 (PRIOR ART)
FIG. 1 is a side view of an existing, prior art drum mooring winch before replacement of the winch drum with a traction winch module in accordance with the present invention.
Figure 2:
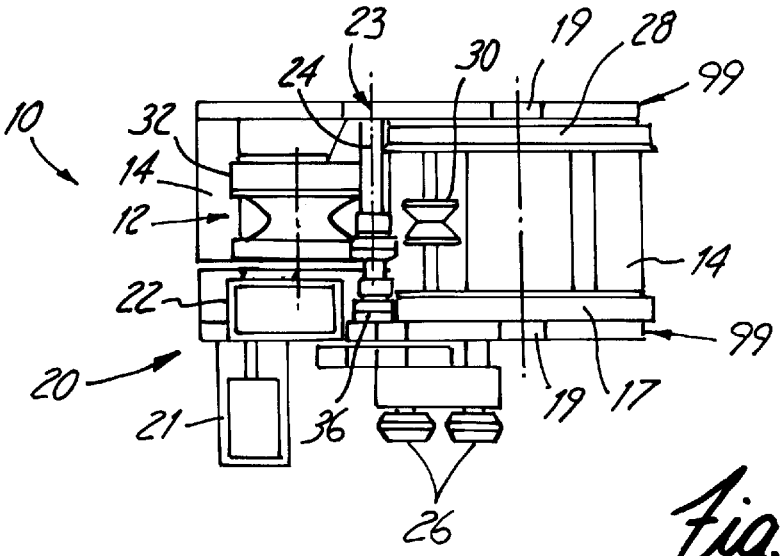
Fig. 2 (PRIOR ART)
FIG. 2 is a top plan view of an existing, prior art drum mooring winch before replacement of the winch drum with a traction winch module in accordance with the present invention.

FIGS. 1 and 2 depict an existing drum mooring winch 10 as known in the prior art. (For example, Continental Emsco Company makes a Skagit ETW-350/52 mooring unit, in a double drum, double wildcat configuration. FIGS. 1 and 2 show just one drum of such a mooring unit.) The foundation for the winch 10 is a mooring winch frame 12 (e.g., a drum winch bed frame), which includes two or more cross beams 14. Mooring line, e.g., 3.5 inch wire rope 90 (FIG. 2), is wound onto winch drum 16, which rotates on an axle 18 that is supported on pillow blocks 19 mounted in frame side members 99. A windlass 32 is also provided for handling chain.

The winch drum 16 is driven by a drive (or power train) system 20 that includes an electric motor 21, a gear box 22, an intermediate drive shaft assembly 23, and dynamic brakes 26. The electric motor 21 supplies driving rotation to the gear box 22, which in turn drives the intermediate drive shaft assembly 23. The drive shaft assembly 23 includes an intermediate drive shaft 24 and a pinion gear 36, which is mounted to the intermediate drive shaft 24. In one embodiment, pinion gear 36 is clutched to intermediate drive shaft 24 with an air-actuated, jaw-type clutch (not shown). The pinion gear 36 engages the gear teeth (not shown) on the winch drum gear 17 to drive winch drum 16. In addition, winch drum 16 has brakes 28 and a pawl (not shown) and is accompanied by a levelwind mechanism 30, which enables even distribution of the wraps of the line 90 onto the winch drum 16 when line is being hauled-in.

The mooring winch frame 12 is connected to the deck 8 of an offshore loading vessel (or other vessel) at a hinge pin 42 and a load cell (or transducer) 40. When the winch 10 is loaded with mooring force (e.g., during a hauling-in operation), the load cell 40 compresses and provides tension information for the mooring line. This tension information is provided to a load-sensing system, which may be part of a control system, e.g., for controlling a hauling-in process.

Replacement Traction Winch Module

Figure 3:
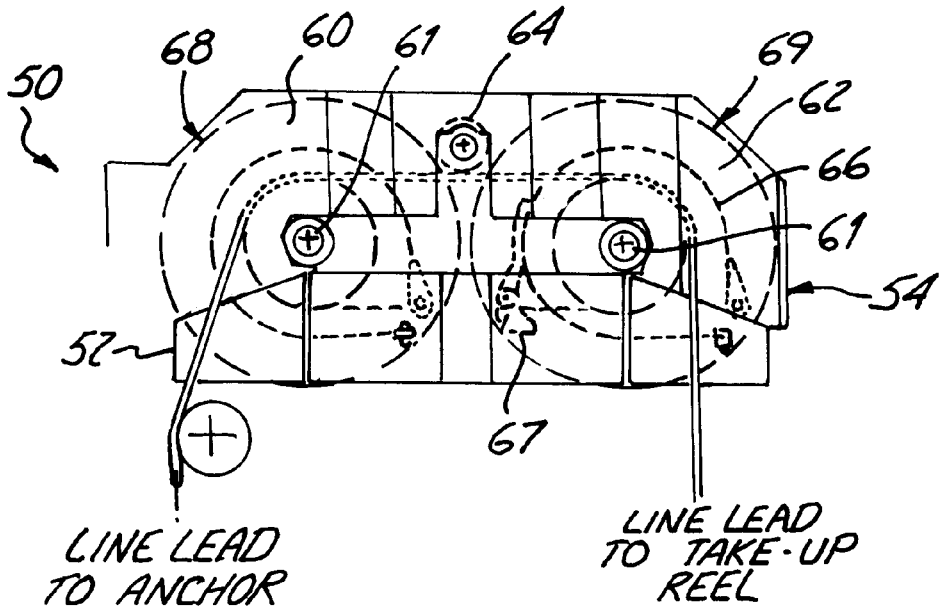
FIG. 3 is a side view of a replacement traction winch module in accordance with the present invention.
Figure 4:
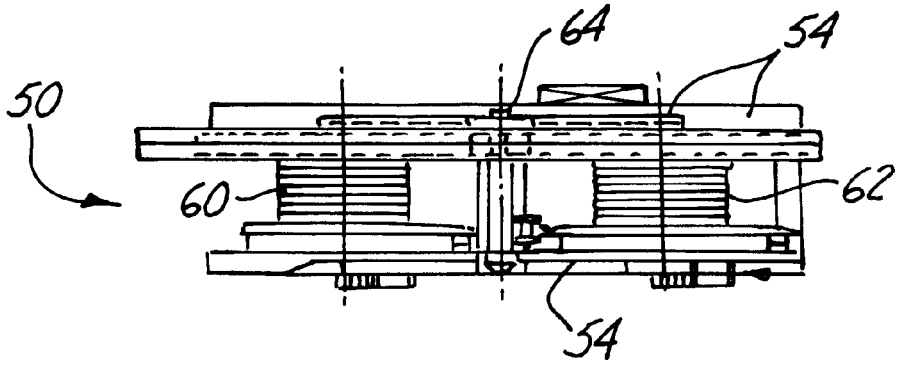
FIG. 4 is a top plan view of a replacement traction winch module in accordance with the present invention.

FIGS. 3 and 4 depict one embodiment of a unitary replacement traction winch module 50 in accordance with the present invention. The module 50 may be based on an existing traction winch, selected to have the size and capacity desired and adapted to form the replacement module 50. For example, AmClyde Engineered Products, Inc. of St. Paul, Minn., manufactures an AmClyde Model TW-350 Traction Winch Assembly that can be so adapted. For efficient and effective conversion of a drum winch into a traction winch, traction winch module 50 includes its own traction winch frame (e.g., a bed frame) 52, which is designed to mount on the mooring winch frame 12 and fit between pillow blocks 19 from the existing drum winch 10. Traction winch frame 52 supports a main load beam and pillow block assembly 54, which in turn supports front and rear traction drums 60, 62, respectively. (A "front" traction drum is a drum located on the anchor side of the mooring line relative to another traction drum; while a "rear" traction drum is a drum located on the take-up reel side of the mooring line relative to another traction drum. It is understood, however, that the front and rear drums need not have a horizontal relationship; one can be located above the other.)

Traction drums 60, 62 are rotatably mounted on fixed, non-rotating drum axles 61 with anti-friction roller bearings (not shown). The drum axles 61 are supported by load beam/pillow block assembly 54 and are clamped solidly to the traction winch frame 52. Traction drums 60 and 62 are rotatably linked by an idler shaft 64. The front traction drum 60 has a front traction drum gear 68 for driving rotation of front traction drum 60 and transmitting rotation through an idler pinion on idler shaft 64 to a rear traction drum gear 69 attached to the rear traction drum 62.

The traction winch module 50 also includes a drum brake 66 on each drum and a pawl mechanism 67 on the rear traction drum 62. Traction winch module 50 may also include air actuated maintenance dogs (not shown), which are provided for added safety, as well as for maintenance of the traction winch module 50.

In one embodiment, the traction drums 60, 62 are heavy duty combination cast and fabricated steel structures. Each drum has a suitable number of machined grooves to accommodate the particular mooring line being used. In addition, each groove has a root diameter for providing a suitable D/d ratio. For example, with a 3.5 inch wire rope mooring line, a drum could have seven grooves, with each groove having a 60 inch root diameter to provide a 17:1 D/d ratio.

The traction winch module 50 is designed to be positioned on and affixed to an existing mooring winch frame 12 and to fit between its pillow blocks 19. (This allows continued use of the existing load-sensing system.) In one embodiment, the traction winch frame 52 is a heavy duty, fabricated steel structure, and it is designed and manufactured to withstand maximum possible loads which may be imposed upon it. It is arranged so that it may be mounted (e.g., welded) to the existing mooring winch frame 12. New foundation pads 70, 72 may be used to form a connection between the traction frame 52 and the mooring winch frame 12.

Converted Winch

Because of its two-drum structure, the traction winch module 50 is necessarily longer than the diameter of the winch drum 16 that it is to replace. On the other hand, because they do not carry many wraps of mooring line, the traction drums 60, 62 can be made narrower than the width of winch drum 16. Thus, the replacement traction winch module 50 does not fit neatly into the space vacated when a winch drum 16 is removed. However, as described next, it can be positioned to adapt to the mooring winch frame 12.

Figure 5:
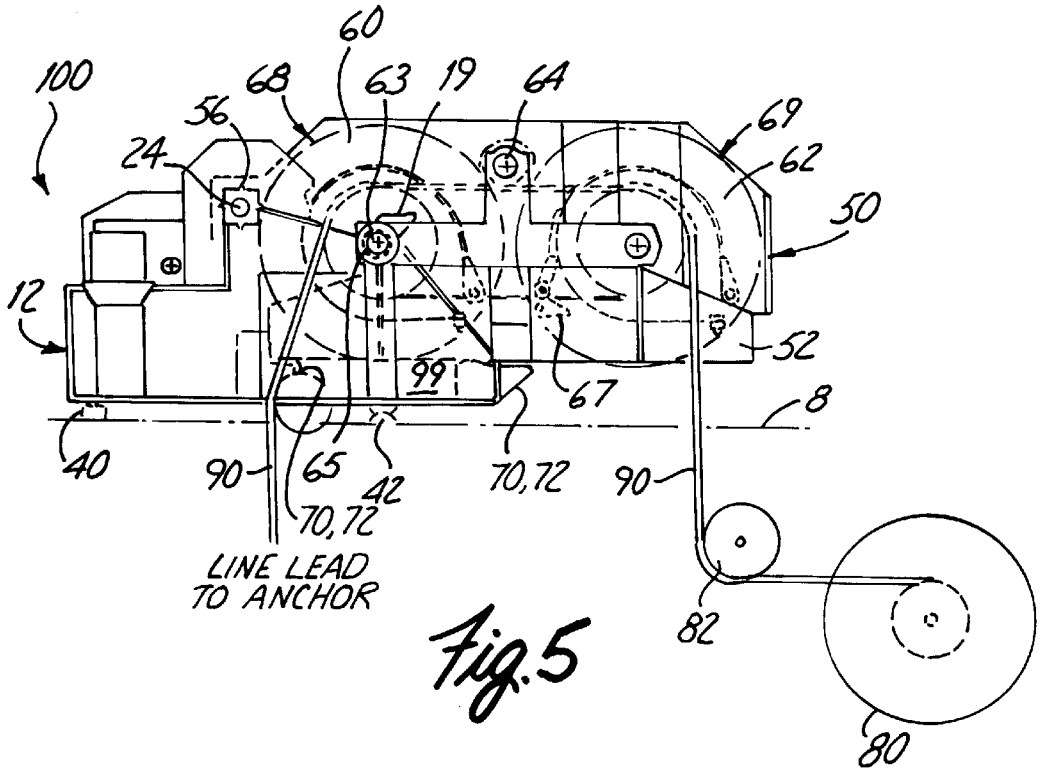
FIG. 5 is a side view of the replacement traction winch module of FIGS. 3 and 4 installed in place of a winch drum as shown in FIG. 1.
Figure 6:
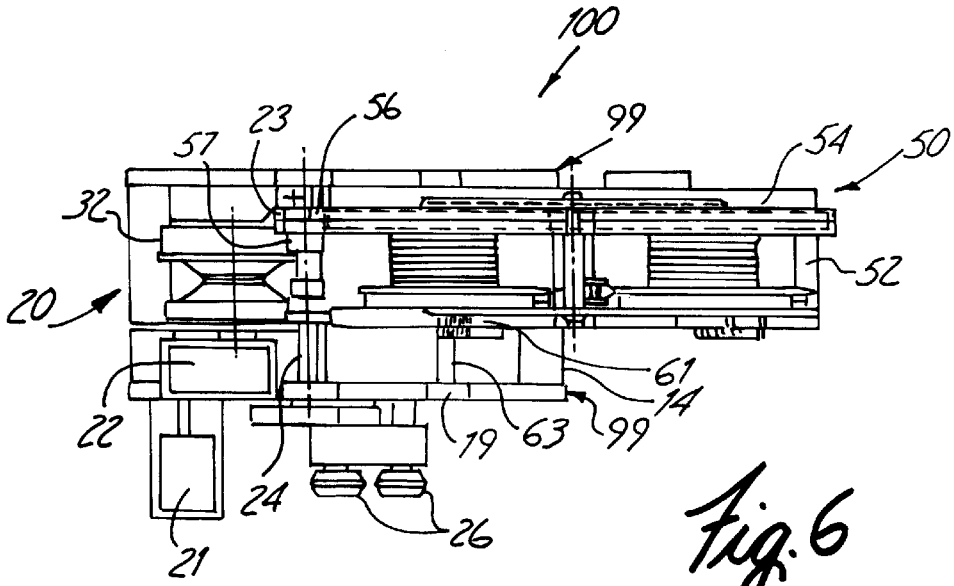
FIG. 6 is a top plan view of the replacement traction winch module of FIGS. 3 and 4 installed in place of a winch drum as shown in FIG. 1.

FIGS. 5 and 6 show a converted winch 100, which incorporates traction winch module 50 of FIGS. 3 and 4 installed in the existing drum mooring winch structure of FIGS. 1 and 2, to replace the removed winch drum 16. Converted winch 100 also includes flag sheave 82 and take-up reel 80. Take-up reel 80 (e.g., an AmClyde Model TUW-350 electrically powered take-up reel, available from AmClyde Engineered Products, Inc., St. Paul, Minn.) is designed and arranged to store mooring line 90 from the traction winch module 50. It also provides the necessary back tension, which is required for proper operation of the traction winch module 50. A levelwind and a guide sheave (not shown) may also be provided for take-up reel 80 to ensure proper spooling of the mooring line 90 onto the take-up reel 80. If greater line storing capacity is desired, the take-up reel should have greater storage capacity than the removed winch drum 16. In addition, the converted traction winch 100 may also include foundational supplements, such as foundation pads 70, 72, to provide increased support and connection for the mooring winch module 50.

Referring also to FIGS. 1 and 3, one embodiment of a method for converting a drum winch into a traction winch in accordance with the present invention is set forth below. (It should be recognized that the particular order of the steps for performing this conversion is not critical to the overall invention.)

Initially, the existing drum 16, axle 18, drum gear 17, brakes 28, pawl (not shown) and levelwind 30 are removed. Next, the existing intermediate drive shaft assembly 23 is disassembled by removing the drive shaft 24 and disassembling the associated drive shaft gears, bearings, clutches, brakes, and coupling. The drive shaft assembly 23 is then re-assembled with existing gears, clutches, bearings, brakes, and coupling but with the winch pinion 36 (or a new winch pinion 56) axially relocated as (and if) necessary to enable it to mate with and link to the front traction drum gear 68 of the front traction drum 60. Next, the new modified drive shaft assembly 23 is installed. The new drive shaft may require an additional support bearing 57 located near the new (or relocated) winch pinion 56 (36). In addition, it may be necessary to modify the existing mooring frame 12 with foundational supplements to accept the somewhat different dead or live loads of the new traction winch module 50, by e.g., adding foundation pads 70, 72 and/or stiffening cross beams 14.

The traction winch module 50 is then installed. Specifically, the traction winch module 50 is placed on the existing mooring frame 12. In order to keep the existing design largely in balance and to utilize as much as possible of the existing winch structure, front drum 60 is placed so that its axle 61 is above the existing mooring frame 12, while the axle of rear drum 62 may be cantilevered away from the existing mooring frame 12. Depending on available space above the frame 12, both traction drums 60, 62 could be located above frame 12. What is important is that the line 90 leading to the anchor from front drum 62 and the position of front drum 62 cause the winch module 50 to deliver to the existing mooring frame 12 forces similar to those imposed by the removed winch drum 16. Note that existing pillow blocks 19 may be used to position the traction winch module 50 by centering the axle of the front traction drum 60 along the same axis as was used by the removed winch drum 16. This can be facilitated by use of temporary axle extensions 63 placed between each end of the front drum axle 61 and a removable sleeve 65 placed in each of the existing pillow blocks 19 to temporarily receive temporary axle extensions 63. Note that this alignment causes the mooring forces borne at axle 61 of front drum 60 to introduce forces at essentially the same location as removed winch drum 16. This is because the mooring line 90 extends from the traction winch module 50 on much the same path as it did with the winch drum 16.

Once the traction winch module 50 is installed and its traction winch frame 52 is fixed (e.g., by welding or bolting) to the mooring winch frame 12, the temporary axle extensions 63 and removable sleeves 65 can be removed. Next, any necessary guide sheaves (not shown) for guiding the mooring line 90 between the take-up reel 80 and rear traction drum 62 may be installed. Structure and foundation for these guides may be added as necessary. The take-up reel 80 and the flag sheave 82 are then installed with the take-up reel levelwind (not shown). Again, structure and foundation may be added as necessary. The mooring line 90 is then brought through the resulting assembly.

When a mooring force is applied to line 90 wrapped on the traction winch module 50, the reaction points of mooring winch frame 12 exert essentially the same transferred load to the deck 8 of the offshore loading vessel as when the replaced drum winch 16 was in use. Thus, the mooring winch frame 12 will still rotate around hinge pin 42 and apply compression to load cell 40. Any readings taken at this load cell 40 are accordingly still valid, and existing control systems using data from the load cell 40 will still function, with appropriate scaling for any changed dead load forces.

Other Embodiments

It will be seen by those skilled in the art that various changes may be made without departing from the spirit and scope of the invention. For example, the conversion steps may be performed in various orders (e.g., the drive shaft assembly including the pinion gear may be re-assembled prior to or after the traction winch module has been mounted onto the mooring winch frame). In addition, the pinion gear could drive the traction module by driving the idler gear rather than by driving the traction drum gear.

Further, it will be seen that placement of the traction winch drums 60, 62 may be varied, so long as (a) the traction winch frame 52 carries the line loads into mooring line frame 12 in substantially the same way as those that were introduced into the frame 12 by the replaced drum winch 16 and (b) the drums 60, 62 can be linked with a linking assembly to the existing drive system 20. This occurs when the mooring line 90 is led to the anchor within an area bounded by the two frame side members 99 and two imaginary lines perpendicular to the side members 99, one passing through hinge pin 42 and the other passing through load cell 40. Preferably, the area is bounded by the two frame side members 99 and two imaginary lines perpendicular to the side members, one passing through the hinge pin 42 and the other formed by projecting the axis of windlass 32 onto the deck 8. This is approximately the area occupied by the levelwind 30 used with the drum winch 16.

Accordingly, the invention is not limited to what is shown in the drawings and described in the specification but only as indicated in the appended claims.

With the present invention, a drum mooring winch for an offshore loading vessel can be converted into an improved traction winch in a minimal amount of time while the vessel remains at sea. In one embodiment, the traction winch module comes as an essentially complete unit on a frame of suitably narrow width to fit between the pillow blocks of the existing drum winch. It may also be part of a kit that includes: a traction winch module for replacing the winch drum after its removal, the traction winch module being adapted for mounting onto the mooring winch frame and including a traction frame, a front traction drum and a rear traction drum; a linking assembly for drivingly linking the drive shaft with the traction winch module; a take-up reel for storing the hauled-in mooring line from the traction winch module; and foundational supplements for adding to the mooring winch frame to accommodate load changes caused by the traction winch module. The front and rear traction drums are already installed on a traction frame, as are brake and pawl mechanisms. Thus, little mechanical work is needed to do the installation, and there is usually no need to cut or otherwise modify significantly the mooring winch frame or the pillow blocks of the existing drum winch, except for possible foundational supplements, such as limited strengthening of beams. The existing reaction points are maintained and any load measurement cells can remain in place, continuing to provide readings of the forces acting at the reaction points.

In addition, the existing mooring frame, dynamic brakes, and power train system can be retained and incorporated into the converted traction winch. Moreover, with this solution, windlass performance is not changed and structural loads are not materially increased.

Other advantages of the present invention will become more fully apparent and understood with reference to the appended drawings and claims.

We claim as follows:

1. A method for upgrading a drum winch, the drum winch having:

(1) a mooring winch frame, (2) a winch drum rotatably mounted to the mooring winch frame for hauling-in a mooring line, and (3) a drive shaft rotatably mounted to the mooring winch frame for driving the winch drum, the method comprising:

replacing the winch drum with a traction winch module positioned on the mooring winch frame, the traction winch module including a traction winch frame, a front traction drum and a rear traction drum, and being positioned such that the mooring line maintains substantially the same relationship with the mooring winch frame as with the drum winch;

affixing the traction winch frame to the mooring winch frame; and drivingly linking the drive shaft with the traction winch to drive the traction winch module for hauling-in the mooring line.

2. The method of claim 1, wherein the winch drum is mounted on pillow blocks in the mooring winch frame and the act of replacing the winch drum with a traction winch module comprises:

removing the winch drum from the mooring winch frame; and placing the traction winch module between the pillow blocks of the mooring winch frame, the traction winch module having a traction drum gear positioned near the drive shaft so that it may be linked with a pinion gear mounted to the drive shaft.

3. The method of claim 2, wherein the act of removing the winch drum from the mooring winch frame further includes the act of removing one or more of a levelwind, a pawl, and brakes from the drum winch.

4. The method of claim 1, wherein the act of linking the drive shaft with the traction winch includes the act of relocating a pinion gear that was used to drive the winch drum.

5. The method of claim 1, further comprising adapting the mooring winch frame with one or more foundation supplements to accept the traction winch module.

6. The method of claim 5, wherein the act of adapting the mooring winch frame to accept the traction winch module includes the act of adding foundation pads to the mooring winch frame.

7. The method of claim 6, wherein the act of adapting the mooring winch frame to accept the traction winch module includes the act of stiffening a cross beam of the mooring winch frame.

8. The method of claim 1, further comprising the act of providing an additional support bearing for the drive shaft.

9. The method as described in claim 1 wherein the mooring winch frame has pillow blocks for supporting the winch drum and the act of replacing the winch drum with the traction winch module comprises the act of using the pillow blocks to align the front traction drum.

10. The method of claim 9, wherein the act of using the pillow blocks to align the front traction drum includes the acts of:

removably placing temporary axle extensions on the front traction drum;

removably placing sleeves in the pillow blocks; and installing the traction winch module into the mooring winch frame so that the temporary axle extensions are inserted into the sleeves, whereby the front traction drum is substantially axially aligned with the pillow blocks.

11. The method of claim 1, further comprising the act of installing a take-up reel for storing the mooring line.

12. The method of claim 1 further comprising the act of implementing a load cell that at least partially supports the mooring winch frame for providing tension information to control the hauling-in of the mooring line with the traction winch, wherein the load cell was previously used to provide tension information to control the hauling-in of the mooring line with the replaced winch drum.

13. The method of claim 1, wherein the act of replacing the winch drum with a traction winch module comprises positioning the mooring line such that the mooring line passes through the mooring winch frame in substantially the same location as with the drum winch.

14. The traction winch produced by the method of claim 1.

15. A traction winch for hauling in a mooring line, the traction winch comprising:

(a) a mooring winch frame from a drum winch, the mooring winch frame being at least partially supported by a load cell for providing tension information corresponding to the tension of a mooring line being hauled in by the drum winch;

(b) a drive shaft rotatably mounted to the mooring winch frame;

(c) a traction winch module for hauling-in the mooring line, the traction winch module being mounted upon the mooring winch frame and including a traction winch frame, a front traction drum, a rear traction drum, and a gear for driving the traction winch module to haul in the mooring line; and (d) a linking assembly drivingly linking the drive shaft and the traction winch module, wherein the load cell provides tension information corresponding to the tension of the mooring line when it is being hauled in by the traction winch module.

16. The traction winch of claim 15, wherein the traction winch module includes an idler shaft to rotatably link the front and rear traction drums.

17. The traction winch of claim 15, wherein the mooring frame is hingedly connected to a deck of an offshore vessel, whereby said mooring winch frame is at least partially supported by the load cell.

18. The traction winch of claim 15, wherein the mooring winch frame comprises one or more foundational supplements.

19. The traction winch of claim 18, wherein the one or more foundational supplements comprises a stiffened cross bar.

20. The traction winch of claim 18, wherein the one or more foundational supplements comprise one or more foundational pads.

21. The traction winch of claim 15, wherein the mooring winch frame includes pillow blocks and wherein the traction winch module is mounted between the pillow blocks.

22. The traction winch of claim 15 further comprising a power train system from the drum winch for driving the drive shaft, the power train system including one or more of a motor, a gear box, and a gear axially mounted to the drive shaft and rotatably coupled with the gear box for driving the drive shaft.

23. The traction winch of claim 15 including a support bearing for supporting the drive shaft, the support bearing being located near a pinion gear on the drive shaft that is part of the linking assembly.

24. A traction winch for hauling-in a mooring line, the traction winch comprising:

(a) a mooring winch frame from a drum winch having a drum assembly, the mooring winch frame being connected to a deck of an offshore vessel;

(b) a drive shaft rotatably mounted to the mooring winch frame and aligned for driving the drum assembly;

(c) a traction winch module for hauling-in the mooring line, the traction winch module being supported by and mounted upon the mooring winch frame, and the traction winch module including a traction winch frame, a front traction drum and a rear traction drum; and (d) a linking assembly linking the drive shaft and the traction winch for driving the traction winch module to haul in the mooring line.

25. The traction winch of claim 24, wherein the traction winch module includes an idler shaft to rotatably link the front and rear traction drums, wherein the rear traction drum is driven by the front traction drum.

26. The traction winch of claim 24, wherein the mooring winch frame is hingedly connected to a deck of an offshore vessel, wherein said mooring winch frame is at least partially supported by a load cell for providing tension information.

27. The traction winch of claim 24, further comprising a foundation pad located between the mooring winch frame and the traction winch module.

28. The traction winch of claim 24, wherein the mooring winch frame includes a stiffened cross bar.

29. The traction winch of claim 24 further comprising a power train system from the drum winch for driving the drive shaft, the power train system including one or more of a motor, a gear box, and a gear axially mounted to the drive shaft and rotatably coupled with the gear box for driving the drive shaft.

30. The traction winch of claim 24 further comprising a support bearing connected to the drive shaft near a pinion gear for supporting the drive shaft.

31. A traction winch conversion kit for converting a drum winch having a mooring winch frame for supporting a winch drum and a drive shaft, the kit comprising:

a traction winch module for replacing the winch drum after its removal, the traction winch module being adapted for mounting onto the mooring winch frame and including a traction frame, a front traction drum and a rear traction drum;

a linking assembly for drivingly linking the drive shaft with the traction winch module;

a take-up reel for storing the hauled-in mooring line from the traction winch module; and foundational supplements for adding to the mooring winch frame to accommodate load changes caused by the traction winch module.

32. The kit of claim 31, wherein the traction winch module includes an idler shaft to rotatably link the front and rear traction drums, wherein the rear traction drum is driven by the front traction drum.

33. The kit of claim 31, wherein the mooring winch frame is hingedly connected to a deck of an offshore vessel and is movably supported by a load cell for providing tension information.

34. The kit of claim 31, wherein the foundational supplements comprise at least one foundation pad connected to the mooring winch frame and the traction winch module.

35. The kit of claim 31, wherein the mooring winch frame has at least one cross bar and the foundational supplements comprise supplements for making a stiffened cross bar.

36. The kit of claim 31 wherein the linking assembly includes a replacement pinion gear operably connected to the drive shaft.

37. The kit of claim 36 wherein the linking assembly comprises a pinion gear for mounting on the drive shaft and a support bearing for connection to the drive shaft proximal to the pinion gear for supporting the drive shaft.

38. The kit of claim 31 wherein the traction winch module has a traction drum gear to be drivingly linked with the drive shaft for driving said front and rear traction drums.

39. The kit of claim 38 wherein the linking assembly includes a replacement pinion gear for the drive shaft that drivingly engages the traction drum gear.

40. The kit of claim 31 wherein the take-up reel has a line storing capacity greater than that of the winch drum.

41. A traction winch, comprising:

a mooring winch frame from a drum winch, the mooring winch frame having a rotatably mounted drive shaft;

a traction winch frame mounted to the mooring winch frame, the traction winch frame having a rotatably mounted traction drum; and a linking assembly operably connecting the drive shaft to the traction drum.

* * * * *

UNITED STATES PATENT AND TRADEMARK OFFICE

CERTIFICATE OF CORRECTION

PATENT NO. : 6,089,547 
DATED : June 18, 2000
INVENTOR(S) : Richard J. Juelich, Pierre C. Delago and John C. Lundell It is certified that error appears in the above-identified patent and that said Letters Patent is hereby corrected as shown below:

Title page,
Item [75], Inventors, "Richard A. Juelich, Stillwater; Pierre C. Delago, Afton; John C. Lundell, Brooklyn Park, all of Minn." should read -- Richard J. Juelich, Stillwater; Pierre C. Delago, Afton; John C. Lundell, Brooklyn Park, all of Minn. --

Signed and Sealed this

Twenty-seventh Day of July, 2004

JON W. DUDAS
*Acting Director of the United States Patent and Trademark Office*